US007320560B2

(12) United States Patent
Persson et al.

(10) Patent No.: US 7,320,560 B2
(45) Date of Patent: Jan. 22, 2008

(54) CONTROLLED EXPANSION OF ROCK BOLT

(75) Inventors: Tommy Persson, Dylta-Bruk (SE); Morgan Kanflod, Örebro (SE); Fredrik Öberg, Örebro (SE); Tapio Toivonen, Örebro (SE); Niclas Örjas, Örebro (SE); Hans Gustavsson, Örebro (SE); Göran Sjöstedt, Örebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 138 days.

(21) Appl. No.: 10/555,026

(22) PCT Filed: May 12, 2004

(86) PCT No.: PCT/SE2004/000733

§ 371 (c)(1),
(2), (4) Date: Oct. 27, 2005

(87) PCT Pub. No.: WO2004/099570

PCT Pub. Date: Nov. 18, 2004

(65) Prior Publication Data

US 2007/0036614 A1 Feb. 15, 2007

(30) Foreign Application Priority Data

May 12, 2003 (SE) ..... 0301377

(51) Int. Cl.
*E21D 21/00* (2006.01)
*E21D 20/00* (2006.01)

(52) U.S. Cl. ..... 405/259.3; 405/259.1

(58) Field of Classification Search ..... 405/259.1, 405/259.3; 411/19
See application file for complete search history.

(56) References Cited

U.S. PATENT DOCUMENTS

| | | | | |
|---|---|---|---|---|
| 4,423,986 | A | 1/1984 | Skogberg | |
| 4,509,889 | A * | 4/1985 | Skogberg et al. | 405/259.3 |
| 4,511,289 | A * | 4/1985 | Herron | 405/259.3 |
| 4,634,317 | A * | 1/1987 | Skogberg et al. | 405/259.3 |
| 4,696,606 | A * | 9/1987 | Herron | 405/259.3 |
| 4,954,017 | A | 9/1990 | Davis et al. | |
| 5,765,969 | A * | 6/1998 | K.ang.reby et al. | 405/259.3 |
| 5,997,219 | A * | 12/1999 | Krzysztalowicz et al. | 405/259.3 |

FOREIGN PATENT DOCUMENTS

| | | |
|---|---|---|
| EP | 0272233 | 6/1988 |

* cited by examiner

*Primary Examiner*—Frederick L. Lagman
(74) *Attorney, Agent, or Firm*—Mark P. Stone

(57) ABSTRACT

The present invention is related to a method for manual installation of rock bolts expandable by means of a pressure media comprising manual coupling of a pressure source to a rock bolt to be expanded. The method comprises the steps of an operator starting a sequence whereby the rock bolt is pressurized to a predetermined pressure, and it being ensured that the predetermined pressure is kept for a predetermined period of time. The present invention is also related to such a control system, and an apparatus comprising such a control system.

20 Claims, 2 Drawing Sheets

CONTROLLED EXPANSION OF ROCK BOLT

TECHNICAL FIELD

The present invention is related to an improved method and apparatus for manual installation of rock bolts expandable by means of pressure.

BACKGROUND OF THE INVENTION

Tunnelling often occurs in narrow spaces where it is required that an operator manually installs for example rock bolts and other types of supporting of rock. The manual installation of rock bolts includes an operator manually connecting an installation apparatus to a rock bolt. The installation apparatus comprises an installation arm connected to a pump system by means of which pressurisation of the rock bolt take place.

In the pressurisation, a pressure media, for example water, is pressed into the rock bolt by means of the pump system and more specifically a high-pressure pump, whereby the rock bolt is made to expand. The expanding of the rock bolt requires a pressurisation up to a certain level, and that this pressure is maintained for a period of time that is enough for the rock bolt to be allowed to expand.

The pump system used for pressurisation of rock bolts normally comprises a control system with a low intelligence, and which only strives to keep the pressure from the high-pressure pump constant at a prescribed installation level. The required pressure depends on type of rock bolt, but is often 240 or 300bar.

Between the rock bolt and high-pressure pump there is three way valve, the function of which is to open the flow of liquid into the rock bolt at pressurisation and to shut the flow of liquid from the pump when the installation is completed and then also to drain the rock bolt from the injected liquid. The three way valve is manipulated by the operator via a handle.

A problem with the present manual installation of rock bolts is that the installation procedure is difficult to handle for an operator. Since the operator applies the pressure by pressing in or releasing, respectively, a handle in an installation apparatus, the pressure may sometimes cease and it is also difficult for the operator to decide during how long time a certain pressure has been maintained, and thereby for how long the expansion of the rock bolt has been proceeded. It has turned out that an operator often overestimates the elapsed time when manually installing rock bolts, and is thereby inclined to interrupt the installation process prematurely. In rock bolting it has thus turned out that some of the rock bolts are insufficiently expanded, giving quality problems and inadequate reliability of the supporting of rock.

It would thus be desirable to provide an apparatus and method that simplifies and improves a manual installation of rock bolts.

SUMMARY OF THE INVENTION

It is an object of the present invention to provide an apparatus and method that solve the above problems. More specifically, it is an object of the present invention to provide an improved method and apparatus for manual rock bolting, where an installation process for installing rock bolts is always completed. Another object of the present invention is to provide an apparatus and method for manual rock bolting that eliminates all uncertainty about whether an expandable rock bolt has been installed correctly or not.

These and other objects are achieved in accordance with the present invention by a method for manual installation of expandable rock bolts, as claimed in claim 1, and in accordance with a control system as claimed in claim 8.

In accordance with the present invention the above mentioned objects are achieved by a method for manual installation by pressurisation of expandable rock bolts, comprising manual connection of a pressure source to a rock bolt to be expanded, in which an operator starts a sequence, whereby the rock bolt is pressurized to a predetermined pressure. It is ensured that the predetermined pressure is kept under a predetermined period of time, during installation in progress. Thereby an operator is prevented from prematurely, by mistake, interrupt an installation of a rock bolt, and the quality of the rock support may be guaranteed. An operator may however interrupt an installation by deliberately pressing a reset button, for example if he discovers a leakage or the like.

In accordance with one embodiment of the present invention a signal is given when the installation sequence is successfully performed. Thereby an operator never has to himself evaluate how long an expansion of a rock bolt has been proceeding, and the risk of prematurely interrupting the expansion is thereby eliminated.

In accordance with another embodiment of the present invention a signal is given off, and preferably also an error message, when the installation sequence has not been successfully performed. Thereby the operator is made aware of the fact that an installation has failed and may remake the installation. A quality assured installation of rock bolts is thereby provided.

In accordance with another embodiment of the present invention a timer, or some other means for time metering, is cleared if the predetermined pressure during the predetermined time period is below an indicated pressure level, and is further restarted when the indicated pressure level is again reached. Thereby it is ensured that the pressure required for expanding a rock bolt completely is really held during a prescribed period of time.

In accordance with another embodiment of the present invention a chuck, or another means used for the installation, holds its grip on a rock bolt until the predetermined period of time has elapsed. Thereby a secure and reliable installation of rock bolts is provided.

In accordance with another embodiment of the present invention the starting of the installation requires an action by an operator during a certain period of time before the sequence is started. Thereby a certain amount of time is given the operator to see any possible faults in the system and during which time the operator may prevent the start of the sequence.

The present invention also relates to a control system for manual installation of an expandable rock bolt, whereby advantages corresponding to the above described are achieved.

Further advantages are achieved in different aspects of the invention and will become clear by the following description.

DETAILED DESCRIPTION OF PREFERRED EMBODIMENTS

Figure 1:
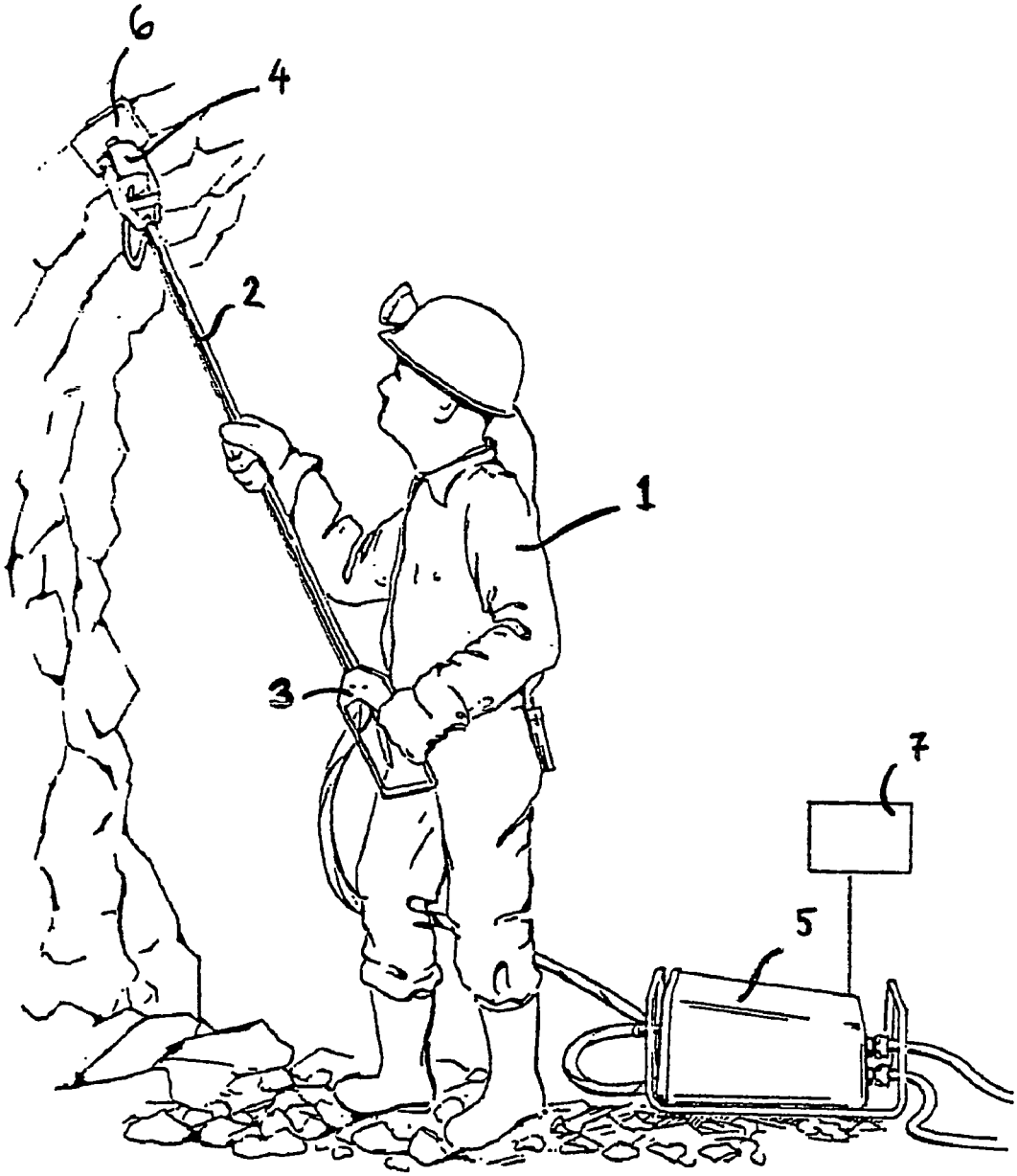
FIG. 1 shows a manual installation of rock bolts.

With reference to FIG. 1 a manual installation of expandable rock bolts in accordance with the present invention will now be described. An operator 1 has access to an installation apparatus for setting of rock bolts comprising an installation arm 2, with a handle 3 in one end and an installation chuck 4 in the other. The installation arm 2 is connected to a high-pressure pump 5, pumping out a pressure media, such as water, with a predetermined pressure into the rock bolt 6. By for example pressing the handle 3, the operator 1 starts an installation sequence, which he then may not interrupt other than by pressing a reset button, which is preferably placed on the high-pressure pump 5.

Unlike the prior art, in which the operator himself has to decide if an installation of a rock bolt is completed and he himself has to evaluate how long a rock bolt has been allowed to expand, in accordance with the present invention the operator 1 only needs to start an installation sequence.

Figure 2:
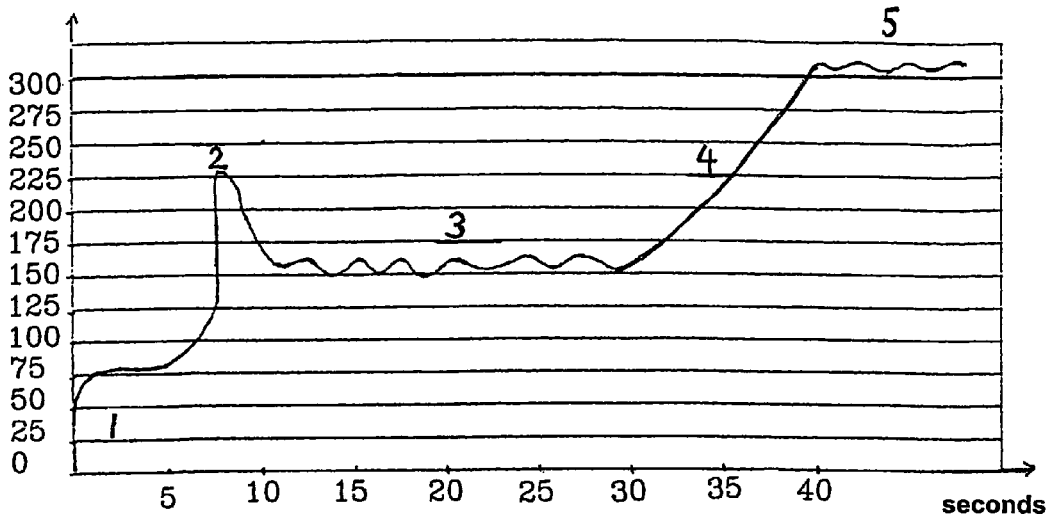
FIG. 2 shows schematically an expansion process for expanding a rock bolt.

With reference to FIG. 2, the expansion process of a rock bolt is now described briefly in order to clarify the installation sequence. During the phase marked 1 the rock bolt is filled with water (or other liquid), whereby the pressure need not be so high. Thereafter the pressure limit for permanent deformation is exceeded, marked by 2. When the permanent deformation occurs, phase 3, the pressure drops somewhat, and the indentation of the rock bolt unfolds and is pressed, in phase 4, to abutment to the rock. In phase 4 elastic strain of the rock also occurs. In the last phase, which is the critical phase for the installation, the pressure reaches the prescribed limit. The pressure should be maintained at this level for a predetermined period of time, typically 6 seconds, in order to allow complete expansion of the rock bolt in the bore hole. Different bolts require different pressures, and even in rock bolts of the same kind the resistance may vary somewhat. A pressure slightly above 300 bars is however usually enough.

The control system 7 in accordance with the present invention has as main function to ensure that the cycle, described in FIG. 2, cannot be interrupted manually by the operator 1. The operator 1 should thus not be able to interrupt the installation by lettibg go of the handle 3, and the installation sequence continues even if the operator 1 should release the handle 3.

The control system 7 is shown in FIG. 1 only schematically as a separate unit connected to a high-pressure pump 5, but it is realised that it may constitute a part of the high-pressure pump 5, or for example form part elsewhere in the pump system. The control system 7 comprises means, for example a timer, that when a prescribed time has elapsed, makes a relay switch off the high-pressure pump 5. The rock bolt should be pressurised with a predetermined pressure during the period of time indicated in phase 5, say 6 seconds, and the chuck 4 does not loosen its grip of the rock bolt 6 before this time has elapsed. If the pressure during this phase should sink below the indicated pressure the timer is reset and restarted when the indicated pressure has again been reached.

Figure 3:
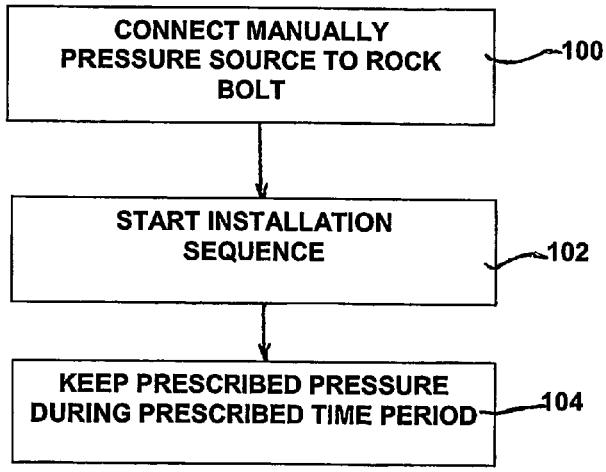
FIG. 3 shows a flow chart illustrating the installation sequence in accordance with the present invention.

The installation comprises the following steps, illustrated by the flow chart of FIG. 3: in step 100 the operator manually connects a pressure source to a rock bolt to be expanded; in step 102 the operator starts a sequence whereby the rock bolt is pressurised to a predetermined pressure; and in step 104 the control system 7 ensures that the predetermined pressure is kept during a predetermined period of time, that cannot be affected by the operator.

For example, when the operator presses in the handle in an installation apparatus for rock bolts, a sensor in the handle may give off a signal to the control system 7, whereby the installation sequence is started. The sensor is connected to a control system 7 controlling the high-pressure pump 5. The control system 7 then starts a time metering, for example by means of a timer, and controls that a set pressure is reached in the rock bolt during a certain, prescribed time (the time and the pressure corresponding to phase 5 in FIG. 2). When the prescribed time period has elapsed, a relay, that receives a signal from the timer when the prescribed time has elapsed, may switch off the pressure source, for example the high-pressure pump 5. The time metering need not be governed by a mechanical unit, but may of course alternatively be accomplished by software. When the prescribed time has elapsed, the operator knows that the installation is finished, and is then certain that the rock bolt has been installed correctly.

The three way valve described in the introduction may thus in the present invention be eliminated and be replaced with for example a sensor.

Sometimes it happens that a rock bolt cannot be expanded, for example if there is no hole in the rock bolt. If that is the case, the pressure will reach the indicated value immediately and the sequence is interrupted after the predetermined period of time as usual. The rock bolt will then however not be expanded and there is no danger that a partly expanded rock bolt stays in the bore hole. Thereby the operator is aware of the fact that the rock bolt is defective and the quality of the rock support can thereby always be guaranteed.

The control system 7 also handles the situation that come up when the prescribed pressure in the rock bolt cannot be reached, as is the case for example when a rock bolt is leaking. The operator may then stop the high-pressure pump by pressing the reset button on the handle of the installation arm or on the high-pressure pump itself, or the like. Alternatively a function may be implemented where for example a timer controls that the sequence is performed within a prescribed maximum period of time, within which the prescribed pressure should have been reached and held during the prescribed time period. The timer is then set on a time period concerning the total installation time, and if this time period is exceeded the installation sequence is interrupted. It is important that the total installation time period set is not set to be too short, since the installation of the rock bolt then may be interrupted prematurely without the operator being aware of it. If the control system 7 comprises such a maximum installation time, after which the installation sequence is interrupted, a certain signal may be given off in order to alert the operator that the maximum time has been exceeded. Moreover, an error message may be presented to the operator, for example "Installation failed". The operator must then restart (reset) the system.

The above function may be used when the pressure never reaches the prescribed and required level, but also if the pressure suddenly falls below this level before the required time has elapsed. The bolt is then not accurately installed, but has only expanded partly, and the control system 7 should then warn the operator. Partly expanded bolts may for example occur in case a rock bolt starts to leak, or if there arises a leakage in the pump system. Since the operator, in accordance with the present invention, may only interrupt an installation manually by pressing a reset button, and since he otherwise will be presented with an error message or a signal, he will thus always be aware of the case that a rock bolt has not been installed correctly.

If an operator should start an installation sequence by mistake, for example if he starts the sequence without there being a rock bolt in the chuck, the control system 7 senses this, in an alternative embodiment. The control system 7 controls that the increase of pressure is normal, which is not the case for example if there is no rock bolt. The control system 7 then interrupts the sequence and an immediate restart of the same is possible. In an alternative embodiment, the starting of the installation requires action of the operator during a certain determined period of time, for example that the operator presses the handle during a certain period of time, say 2 seconds, before the sequence is started and is so to say locked and can no longer be interrupted by the operator. During this starting phase, before the sequence itself starts, the operator has time to see for example if there is a leakage in the pump system, and may then prevent the start of the sequence.

In accordance with an embodiment of the invention, the control system 7 may also include a counter registering the number of correctly installed bolts. This may for example be advantageous when it is critically important that a certain number of rock bolts have been installed or if statistics is desired.

In accordance with the invention, the expansion of a rock bolt cannot be interrupted prematurely by mistake, and thereby there is no risk for the anchorage of the rock bolt into the rock to be reduced and thereby to render the supporting of rock deficient.

Moreover, by means of the present invention all uncertainty of the operator whether an expandable rock bolt has been installed correctly or not may be eliminated. In accordance with the invention an operator always knows if an installation has succeeded or not.

The control system 7 in accordance with the present invention ensures that the rock bolt 6 is pressurised with a prescribed pressure and that the pressure is then held during a prescribed, required period of time. This provides a very reliable manual installation of rock bolts.

The invention provides the possibility to store pressure and time for individual bolts for later quality follow-up.

The invention claimed is:

1. A method for manual installation of expandable rock bolts by pressurisation, including manual connection of a pressure source to a rock bolt to be expanded, characterised in that the method comprises the steps of:

an operator starting a sequence whereby the rock bolt is pressurised to a predetermined pressure, and ensuring by means of said sequence, and by an apparatus comprising a control system comprising means for ensuring that said predetermined pressure is held during a predetermined period of time, that the predetermined pressure is kept for a predetermined period of time.

2. Method as claimed in claim 1, wherein a signal is given off when the sequence is successfully performed.

3. Method as claimed in claim 2, wherein a signal is given off when the sequence has not been successfully performed.

4. Method as claimed in claim 2, wherein an error message is given off when the sequence has not been successfully performed.

5. Method as claimed in claim 2, wherein a timer is cleared if the predetermined pressure during the predetermined period of time falls below a prescribed pressure level, and is further restarted when the prescribing pressure level is reached again.

6. Method as claimed in claim 1, wherein a signal is given off when the sequence has not been successfully performed.

7. Method as claimed in claim 6, wherein an error message is given off when the sequence has not been successfully performed.

8. Method as claimed in claim 1, wherein an error message is given off when the sequence has not been successfully performed.

9. Method as claimed in claim 1, wherein a timer is cleared if the predetermined pressure during the predetermined period of time falls below a prescribed pressure level, and is further restarted when the prescribing pressure level is reached again.

10. Method as claimed in claim 1, wherein a chuck is used for installation does not release its grip of a rock bolt before the predetermined period of time has elapsed.

11. Method as claimed in claim 1, wherein the starting of the installation requires action from an operator during a certain determined period of time before the sequence is started.

12. A control system for connection to a pressure source for manual installation of expandable rock bolts by pressurisation, characterized in that the control system (7) comprises:

means for ensuring that a rock bolt is pressurized to a predetermined pressure, and means for ensuring that said pressure is held during a predetermined period of time.

13. Control system as claimed in claim 12, wherein said means for ensuring a pressure comprises a timer arranged to determine the duration of the predetermined pressure.

14. Control system as claimed in claim 13, wherein the timer is arranged to be cleared if the desired pressure during a predetermined period of time falls below a given pressure level, and further arranged to be restarted when the given pressure level is again reached.

15. Control system as claimed in claim 12, wherein the the control system (7) comprises a reset button for enabling interruption of the installation.

16. Control system as claimed in claim 12, wherein the control system (7) comprises a counter counting the number of correctly installed rock bolts.

17. Control system as claimed in claim 12, wherein the control system (7) comprises means arranged to give of f a signal when the installation has succeeded.

18. Control system as claimed in claim 12, wherein the control system (7) comprises means arranged to give off a signal when the installation has not succeeded.

19. Control system as claimed in claim 12, wherein an error message is given when the sequence has not been performed successfully.

20. An apparatus for installing an expandable rock bolt by pressurization, said apparatus comprising a pressure source and means for manual coupling to an expandable rock bolt, characterized in that the apparatus comprises a control system (7) as claimed in claim 12.

* * * * *

UNITED STATES PATENT AND TRADEMARK OFFICE

CERTIFICATE OF CORRECTION

PATENT NO. : 7,320,560 B2
APPLICATION NO. : 10/555026
DATED : January 22, 2008
INVENTOR(S) : Tommy Persson et al.

It is certified that error appears in the above-identified patent and that said Letters Patent is hereby corrected as shown below:

Column 6, Line 48 (Claim 17, Line 2):

Delete "of f" and substitute --off--.

Signed and Sealed this

Sixth Day of May, 2008

JON W. DUDAS
*Director of the United States Patent and Trademark Office*